US011140956B2

(12) United States Patent
Teblick

(10) Patent No.: US 11,140,956 B2
(45) Date of Patent: Oct. 12, 2021

(54) FOLDING MECHANISM

(71) Applicant: HEATSAIL, naamloze vennootschap, Kontich (BE)

(72) Inventor: Luc Teblick, Antwerp (BE)

(73) Assignee: HEATSAIL, NAAMLOZE VENNOOTSCHAP, Kontich (BE)

( * ) Notice: Subject to any disclaimer, the term of this patent is extended or adjusted under 35 U.S.C. 154(b) by 0 days.

(21) Appl. No.: 16/641,535

(22) PCT Filed: Aug. 22, 2018

(86) PCT No.: PCT/IB2018/056347
§ 371 (c)(1),
(2) Date: Feb. 24, 2020

(87) PCT Pub. No.: WO2019/038686
PCT Pub. Date: Feb. 28, 2019

(65) Prior Publication Data

US 2021/0153614 A1 May 27, 2021

(30) Foreign Application Priority Data

Aug. 23, 2017 (BE) ..... 2017/5582

(51) Int. Cl.
*A45B 25/02* (2006.01)
*A45B 19/12* (2006.01)
(Continued)

(52) U.S. Cl.
CPC ..... *A45B 25/02* (2013.01); *A45B 19/12* (2013.01); *A45B 23/00* (2013.01); *A45B 25/14* (2013.01);
(Continued)

(58) Field of Classification Search
CPC .... A45B 2023/0093; A45B 2023/0087; E04H 15/58
See application file for complete search history.

(56) References Cited

U.S. PATENT DOCUMENTS 578,649 A * 3/1897 Mass ..... A45B 11/00 135/88.04
2019/0069651 A1* 3/2019 Angelos ..... A45B 25/24

FOREIGN PATENT DOCUMENTS

DE 47 479 7/1889
EP 2 815 673 12/2014
(Continued)

OTHER PUBLICATIONS

International Search Report, PCT/IB2018/056347, dated Nov. 6, 2018.
Written Opinion, PCT/IB2018/056347, dated Nov. 6, 2018.

*Primary Examiner* — Noah Chandler Hawk
(74) *Attorney, Agent, or Firm* — Nixon & Vanderhye

(57) ABSTRACT

A folding mechanism contains a rail which forms a guide for a series of runners which are slideable in relation to each other on the rail, whereby each runner or at least a part thereof is provided with a rib which is attached hingeably on the runner around a shaft largely perpendicular to the longitudinal direction of the rail between an open position whereby the ribs are turned away from the rail and a closed position whereby the ribs are turned towards the rail and whereby at least some of the ribs lying on the same side of the rail are connected with each other using a transmission which, when sliding the runners towards or away from each other on the rail, makes the ribs hinge on the runners.

16 Claims, 6 Drawing Sheets

(51) Int. Cl.

| | |
|---|---|
| ***A45B 23/00*** | (2006.01) |
| ***A45B 25/14*** | (2006.01) |
| ***E04H 15/58*** | (2006.01) |

(52) U.S. Cl.
CPC ..... *E04H 15/58* (2013.01); *A45B 2023/0012* (2013.01); *A45B 2023/0093* (2013.01)

(56) References Cited

FOREIGN PATENT DOCUMENTS

| | | | | | |
|---|---|---|---|---|---|
| EP | 2815673 | A2 * | 12/2014 | ..... | A45B 25/02 |
| FR | 2977457 | A1 * | 1/2013 | ..... | A45B 25/18 |
| WO | WO-2015189451 | A1 * | 12/2015 | ..... | A45B 11/00 |

* cited by examiner

FOLDING MECHANISM

BACKGROUND OF THE INVENTION

Field of the Invention

The present invention relates to a folding mechanism.

Description of the Related Art

More particularly the invention relates to a folding mechanism with ribs which can be folded shut in order to fold up the folding mechanism in a compact manner or be spread open in order to open the folding mechanism.

Such a folding mechanism is for example already known in the world of parasols whereby a cloth is attached to a construction of ribs which are fixed hingeably to the top of an upwardly pointing supporting pole and which can be pushed open from a folded position using spokes which are connected with a nub which can be moved up and down the supporting pole.

A disadvantage is that in order to open and close the parasol a large free area is required around the supporting pole under the opened parasol in order for the ribs to move freely without any obstacles from a closed to an open position and vice versa.

Another disadvantage is that the opened parasol is mostly in the form of a round dome, which means that the design freedom for designers is significantly limited and also this is only applicable for a parasol.

BRIEF SUMMARY OF THE INVENTION

The purpose of the present invention is to provide a solution to any one of the aforementioned and other disadvantages, with a versatile folding mechanism that can be used in many domains and which allows shapes to be designed which, in their open state, are not limited to the round dome form.

To this end the invention relates to a folding mechanism that comprises a rail which forms a guide for a series of runners which are slideable in relation to each other on the rail, whereby each runner or at least a part thereof is provided with a rib which is attached hingeably to the runner around a shaft largely perpendicular to the longitudinal direction of the rail between an open position, whereby the ribs on the rail are turned away and a closed position, whereby the ribs are turned towards the rail and whereby at least some of the ribs are connected to each other by means of a transmission which, by sliding the runners towards or away from each other on the rail, makes the ribs hinge on the runners.

The ribs that are connected to each other by means of a transmission are preferably not located on opposite sides of the rail, and more preferably these ribs are located largely on the same side of the rail, by which is meant within the same segment of 150°, or preferably 120°, or preferably 90°, or preferably 60°, or preferably 45°, or preferably 30° or preferably 15°.

Preferably, the transmission does not co-operate with the ribs on the opposite side of the rail.

The transmission preferably provides a mechanical connection between ribs on the same side of the rail, and preferably between consecutive ribs each provided on consecutive or adjacent runners.

Preferably, the ribs are connected hingeably with the runner to which they are attached and extend from there towards their free end. In other words, preferably, the ribs don't extend in two directions, seen from the hingeable connection with the runner on which they are attached. Any part of a rib That extends from the hingeable connection with the runner in the opposite direction to the main part of the rib is preferably free and therefore not mechanically connected to another rib.

Because the ribs hinge sideways around a shaft largely perpendicular to the rail, the folding mechanism requires only little room to manoeuvre in order to open or close.

If, for example, a cloth is attached on or to the ribs of a folding mechanism according to the invention with a horizontal or flat rail, the result is a parasol with ribs which, when opened or closed, move sideways in a plane and therefore require little free room under the parasol in order to open and close.

In addition, by folding the ribs up against the supporting pole or up together, one obtains a compact unit that, for example, requires little storage space, yet in its open state can still Span a large area in the case of a sunshade or canopy.

In this way, in its open state a sunshade can, for example, cover a useful length of over four metres, while the distance between the furthest runners in a folded up state, i.e. with the runners placed as close to each other as possible and preferably arranged against each other, takes up less than two metres.

In more general terms it can be concluded that in a folded up state, the distance between the furthest runners, amounts to less than 70%, or preferably less than half of the useful length of the folding mechanism.

In a closed state the runners are more specifically arranged close to each other such that the distance between the runners is no greater than twice the length of each runner measured along the rail, and more preferably such that the distance between the runners is no greater than the length of each runner measured along the rail.

By useful length it is meant the distance measured along the rail between the runners that are furthest apart when in an open state.

In this way, a ratio of over 2.7 is achieved between the maximm us u useful age length divided by the length taken up by the runners when these are arranged as close to each other as possible.

This is of great importance for this application given that this means significantly less impact from the wind.

For long-term storage, the freely protruding part of the rail can be removed or hinged, at least if to this end the rail is provided with a removable part or respectively provided with a hinge.

It is clear that such a compact folded state is of crucial importance to a folding mechanism.

Think for example of the safe and tidy winter storage of a sunshade, or the compact storage of an artificial Christmas tree. It is often so that such objects spend most of their time in storage.

The width or span of a sunshade, or more generally of a folding mechanism according to the invention, is the distance between the free ends of the ribs and this is determined by the length of the ribs which can be chosen freely under the invention.

Note that the number of runners can change for the same rail.

The folding mechanism is easy to open and close by sliding the runners further apart, respectively closer together, whereby the ribs unfold automatically.

Preferably the transmissions are such that they hold the ribs parallel to each other when opening and closing the folding mechanism.

In this way the ribs fold open or shut together in a synchronised manner.

According to a preferred embodiment the transmissions are formed with an articulated connection, which connects two ribs to each other vie a hinge connection with each of the two ribs around or parallel to the longitudinal axis of the ribs, whereby the articulated connection between the ribs is provided with at least one articulation with a shaft which runs parallel to the ribs.

Preferably the articulated connection comprises two articulated parts with a central articulation, whereby the shafts of both the hinge connections and the central articulation are parallel to each other.

According to a practical embodiment the articulated connection is composed of two articulated parts in the form of two slats which axe connected to each other with one end through a said articulation, the shaft of which is oriented at an angle in relation to the longitudinal direction of the slats, and which are provided with a said hinge connection with the ribs on their other end, whereby the hinge connections with their shafts run in parallel with and at the seine orthogonal distance from the shaft of the articulation.

In doing so the slats can be folded shut against each other whereby they take up little unused space and even allow the runners to be arranged against each other.

Thanks to this construction, when closing the folding mechanism the articulated connections fold up outside the plane in which the ribs fold up, whereby the articulated connections form no obstacle to fold shut the ribs in a compact manner against each other and against the rail.

One or more additional intermediate ribs may be provided, each in the continuation of or parallel to the shaft of an articulation of a transmission. These ribs can ensure extra support for a cloth or suchlike and extra support for forming the folds in the cloth when folding it up.

As the ribs may differ in length, this gives additional design freedom to designers of, for example, a parasol to diverge from the traditional round form, whereby quirky shapes become possible without complicated structures for the folding mechanism.

The folding mechanism can be provided with a drive to slide at least one of the runners, whereby the drive comprises, for example, an electrical motor or suchlike or an operation involving a cord and pulley system or suchlike, whereby at least one driven runner is connected with other runners via a sequential mechanism in order for these runners to slide in a synchronised manner towards or away from each other. In this way, for example, only one motor is required to slide all runners in a synchronised manner.

According to one aspect of the invention the runners are provided with ribs on both sides of the rail which are attached hingeably thereto and which are connected in pairs through a said transmission, whereby the folding mechanism can unfold on both sides of the supporting pole, offering even more design opportunities for forms which may or may not be symmetrical compared to the beam.

The use of a folding mechanism according to the invention is not limited to a sunshade or parasol, but can also be used in other applications in which a cloth is applied such as in vertical or horizontal sunshades, canopies, wind shields, sails on a sailing boat, a foldable bed and suchlike.

The use of a folding mechanism according to the invention is not limited to applications with a cloth, but can also be used, for example, for a foldable artificial Christmas tree or other foldable trees or plants, whereby the ribs then form, for example, the branches or ramifications of the tree or plant in question.

BRIEF DESCRIPTION OF THE DRAWINGS

With the intention of better showing the characteristics of the invention, some preferred embodiments of a folding mechanism according to the invention and it applications are described hereinafter, by way of an example without any limiting nature, with reference to the accompanying drawings, wherein:

FIG. 3 shows a side view according to the arrow F3 in FIG. 2;

DETAILED DESCRIPTION OF THE PREFERRED EMBODIMENTS

Figure 1:
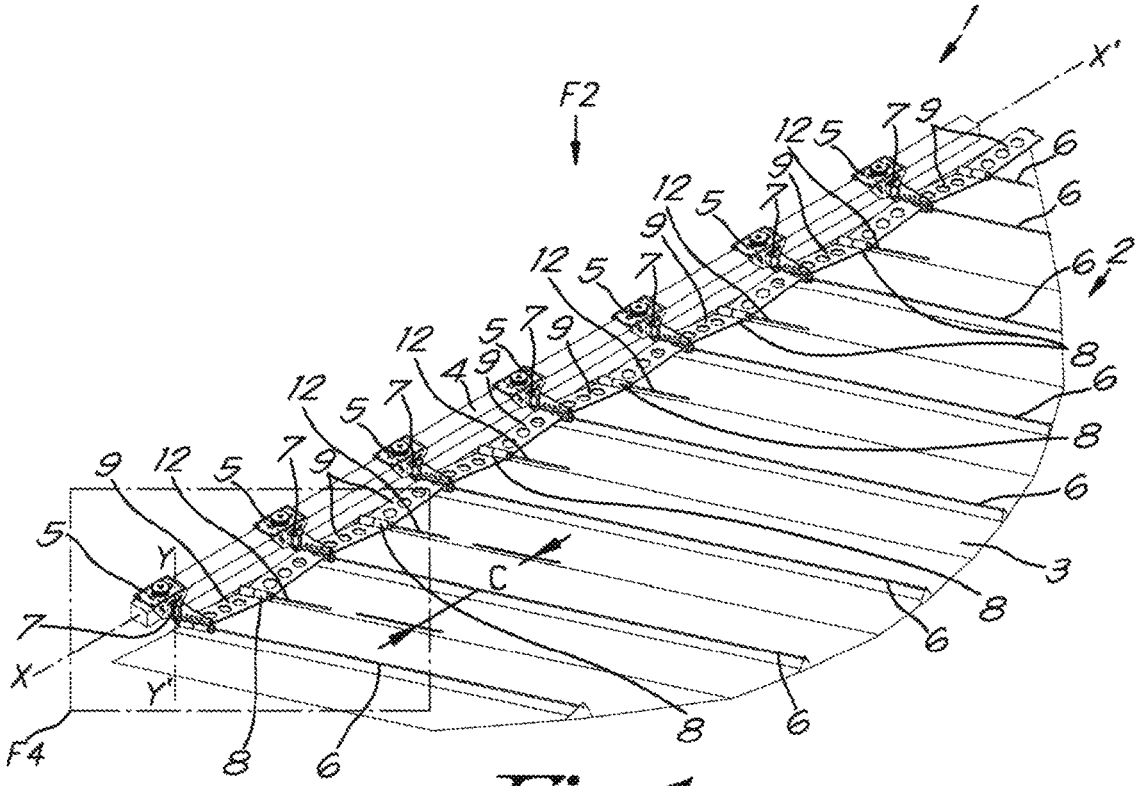
FIG. 1 shows a perspective of a mechanism folded open on one side and used as a canopy or horizontal sunshade with a cloth.
Figure 2:
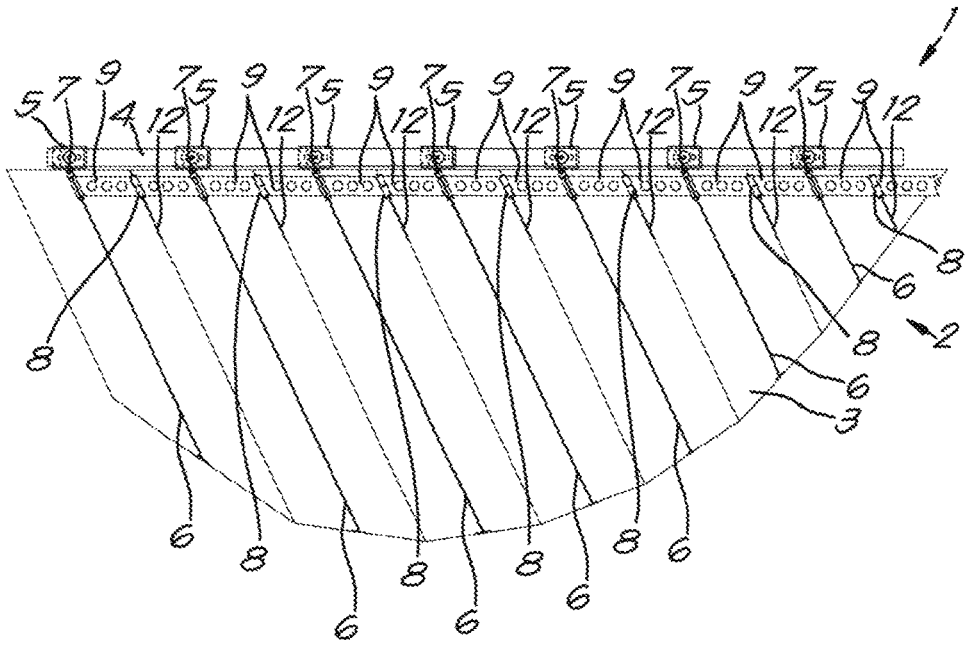
FIG. 2 shows a top view according to the arrow F2 in FIG. 1.
Figure 5:
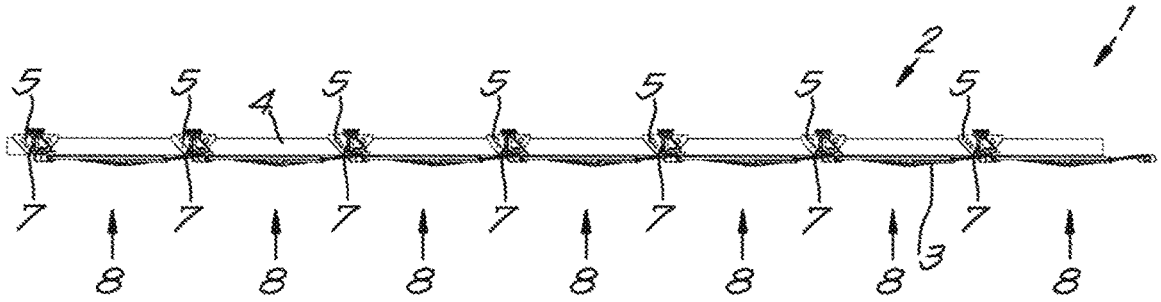
FIG. 5 shows the folding mechanism from FIG. 1 without a cloth and in a folded-up state.

The folding mechanism 1 shown as an example in FIG. 1 is a folding mechanism of a parasol 2 with a cloth 3.

The folding mechanism 1 contains a rail 4 with longitudinal direction X-X' which forms a guide for a series of runners 5 that are slide able in relation to each other on the rail 4.

Each runner 5 is provided on one side of the rail with a rib 6 which is attached hingeably on the runner 5 by means of a shaft 7 which extends, according to the longitudinal direction Y-Y' perpendicularly to the longitudinal direction X-X' of the rail 5, between an open position, as shown in the FIGS. 1 to 4, whereby the ribs 6 in a plane on one side of the rail 5 are turned away from the rail 5, and a closed position, as shown in the FIGS. 5 to 8, whereby the ribs 6 are turned towards the rail 5 and extend practically parallel with the rail 5 close to each other.

Adjacent ribs 6 are connected two by two with each other through a transmission 8 which, when sliding the runners 5 towards or away from each other on the rail 5, makes the ribs 6 automatically hinge around the shaft 7 on the runners 5 and which preferably keeps the ribs 6 parallel to each other when opening and closing the folding mechanism.

In doing so the ribs 6 always move in parallel to one another.

Figure 4:
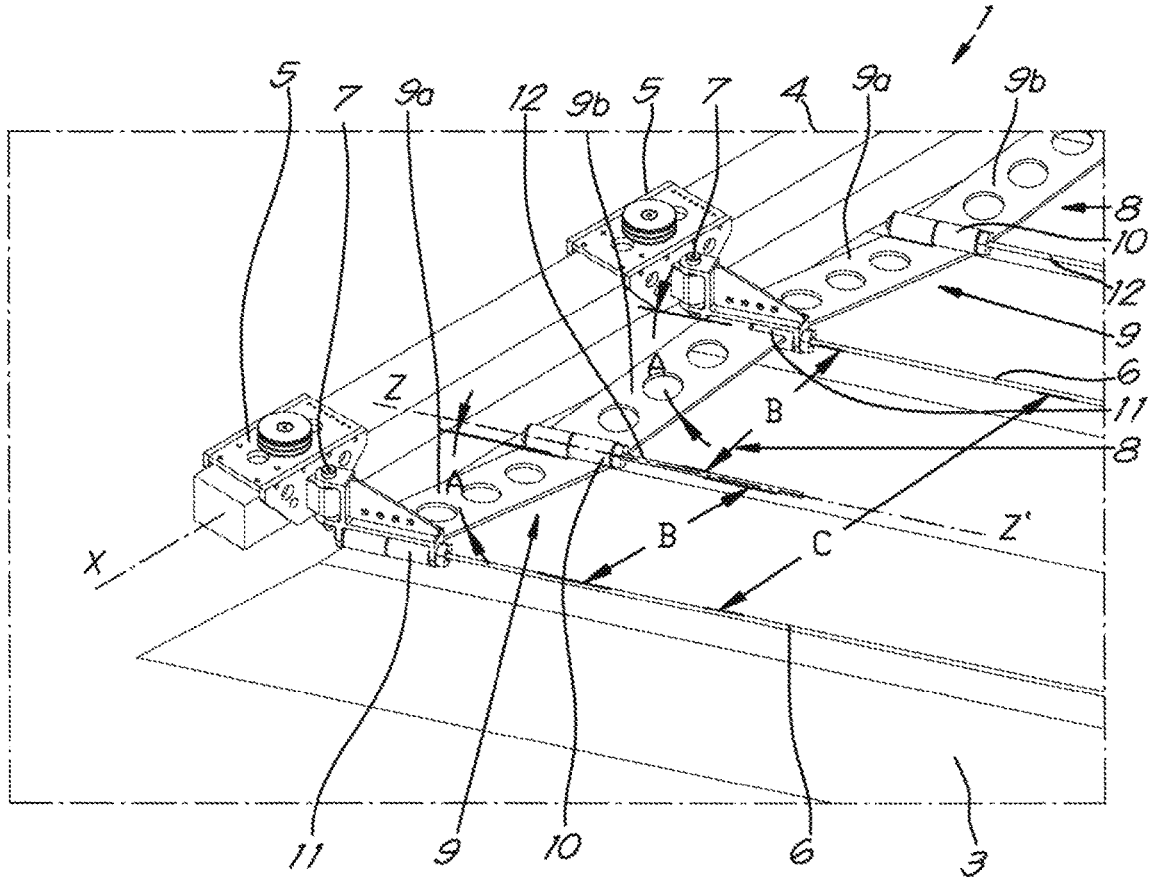
FIG. 4 shows on a larger scale the part that is indicated in FIG. 1 by the frame F4.
Figure 5:
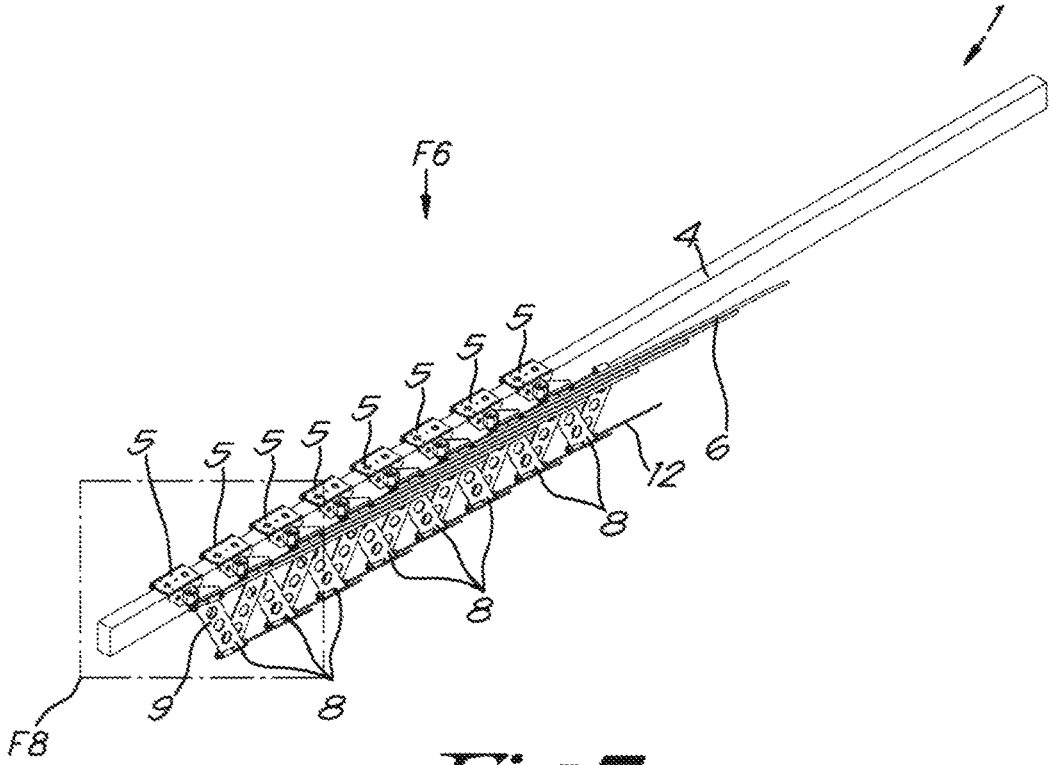
Figure 6:
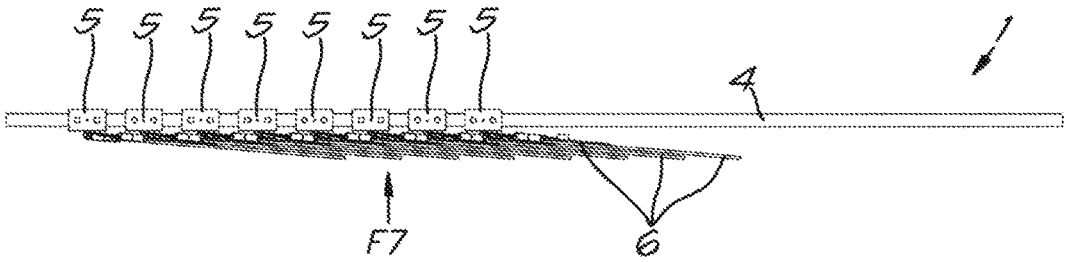
FIG. 6 shows a top view according to arrow F6 in FIG. 5.
Figure 7:
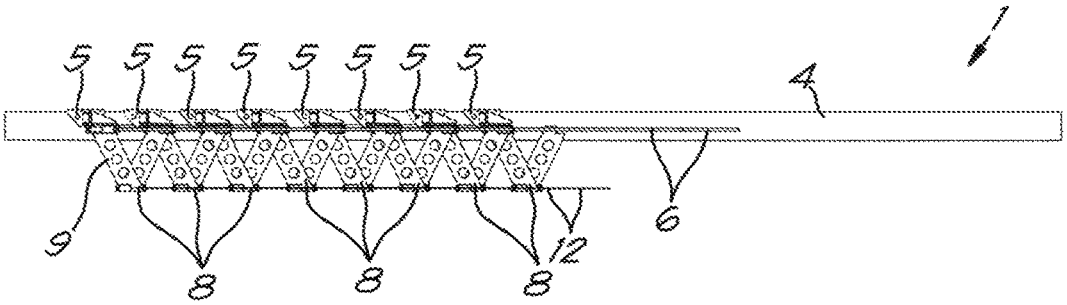
FIG. 7 shows a side view according to arrow F7 in FIG. 6.
Figure 8:
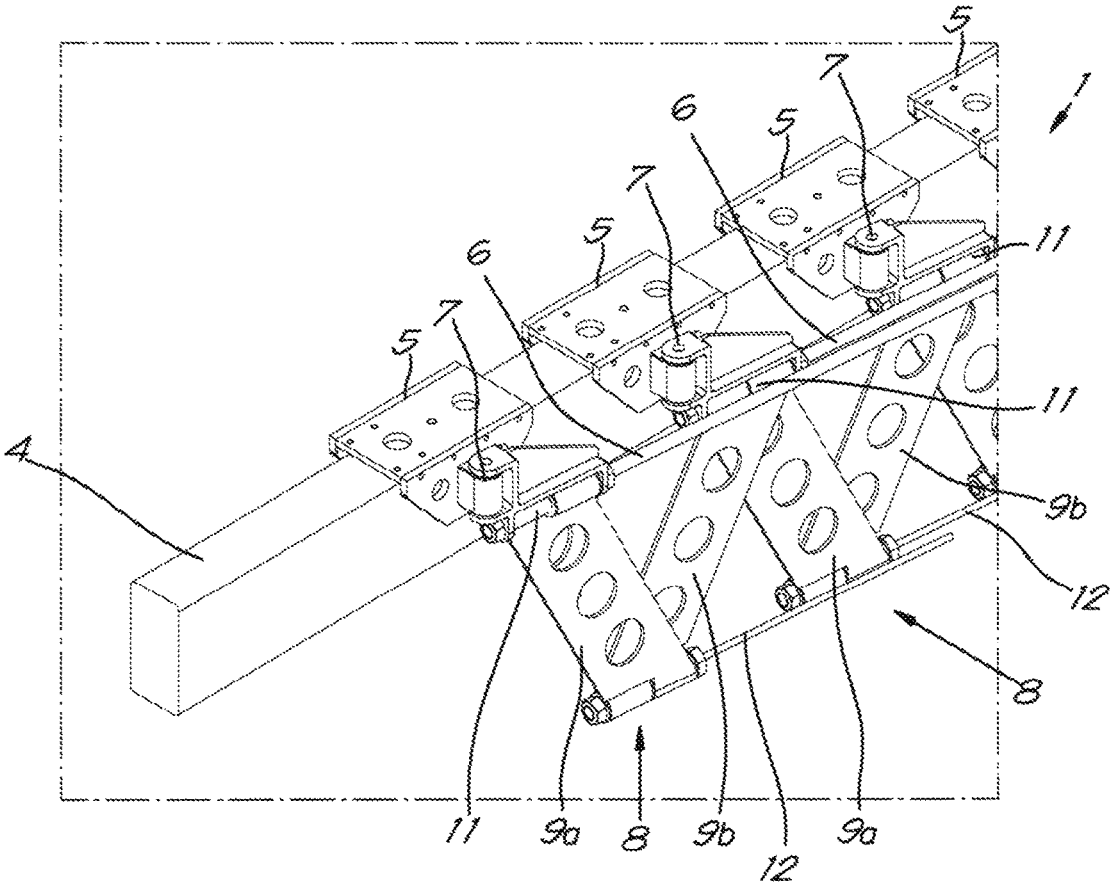
FIG. 8 shows on a larger scale the part that is indicated in FIG. 5 by the frame F8.

Each transmission 8 is formed by an articulated connection 9 with two articulated parts 9*a* and 9*b* in the form of two slats which are connected at one end to each other by means of an articulation with a geometric axis which extends according to the direction Z-Z' and which encloses an oblique angle A to the longitudinal direction of the slats 9*a* and 9*b* as shown in FIG. 4.

On their other end, the slats 9*a* and 9*b* are provided with a hinge connection 11 with the ribs 6, whose hinge axis in the continuation of the ribs 6 runs parallel with the axis Z-Z' of said articulation 10, whereby the hinge connections 11 are located at the same orthogonal distance B from the central articulation 10.

Preferably all transmissions are identical to each other, so that all ribs 6 lie at the same distance C from each other.

When the folding mechanism is an open position as shown in the FIGS. 1 to 4, the articulated parts 9*a* and 9*b* of each transmission lie in or almost in the continuation of each other and run parallel or practically parallel with the rail 4.

In the continuation of the axes Z-Z' of the articulation 10 intermediate ribs 12 can be provided which may, for example, be shorter than the other ribs 11.

The ribs 11 do not necessarily need to be of the same length.

Operation of the folding mechanism 1 is simple and as follows.

Starting from the open state shown in the FIGS. 1 to 4, runners 5 on the rail 4 are slid to one end of the rail 4 as shown in the FIGS. 5 to 8.

In this way the runners 5 are slid closer together whereby the articulated connections 9 fold shut away from the rail 4, more specifically in the case of the FIGS. 5 to 8 fold down and thus away from in-between the ribs 6.

In this way the ribs 6 hinge on the runners 5 towards the rail 4 up to the position in the FIGS. 5 to 8, whereby in the closed position they extend in parallel against or almost against each other beside the rail 4 in a position that runs practically parallel with the longitudinal direction X-X' of the rail 4.

The axes Z-Z' of the articulations 10 and the intermediate ribs 12 extending in the continuation thereof have also turned parallel to each other towards the rail 4, given that shafts of the articulations 10 run parallel with the ribs 6 due to their construction.

Figure 9:
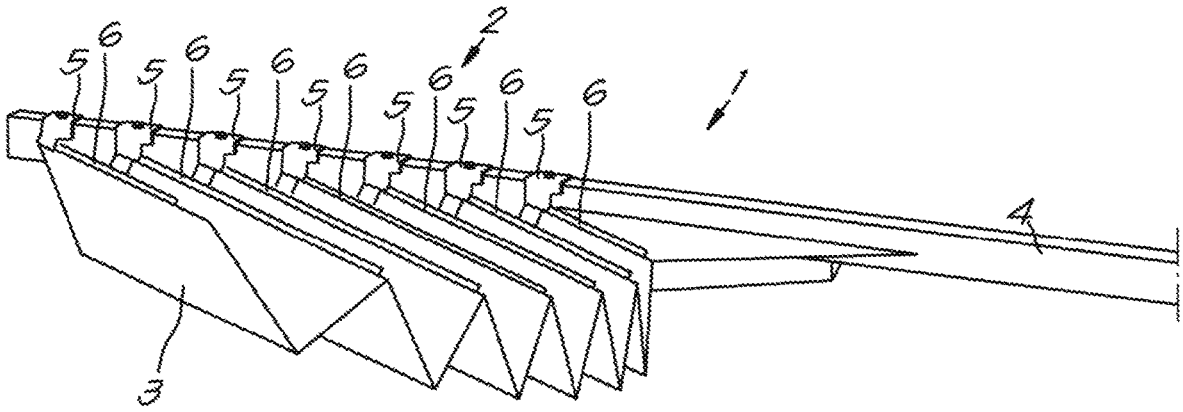
FIG. 9 shows the sunshade from FIG. 8 in a partly folded state.

The cloth 3 is suspended on the ribs 6 and folded up neatly when folding the folding mechanism 1 shut as shown in FIG. 9 with folds that extend downwards as from the ribs 6, the folds being kept in position by intermediate ribs 12 if any.

It is clear that the folding mechanism 1 can be reopened by sliding the runners 5 back out of each other until reaching the position in the FIG. 1.

Although not shown in the figures, the folding mechanism 1 can be provided with a stop for the last runner 5 on the rail 4 in order to prevent the articulated connections 9 from extending entirely and in doing so folding shut in the wrong upwards direction when closing.

The same effect can of course be achieved by ensuring that the cloth 3 is stretched tight before the articulated connections 9 have reached their extended state when folding open the folding mechanism 1.

FIG. 9 shows an application whereby the folding mechanism 1 is used to open and close a sunshade 2, whereby in this case the rail is attached horizontally to a supporting pole 13 on a base 14.

In this case the runners 5 on both sides of the rail 5 are provided with ribs 6 which are connected to each other in pairs by means of articulated connections 6, so that the cloth 3 on the ribs 6 on both sides of the rail 4 can be fixed in order to span a greater surface under the sunshade 2.

In this example in FIG. 9 the folding mechanism 1 is also provided with a drive not shown in the figures used to slide at least one of the runners 5, for example the runner 5 which lies furthest from the supporting pole 13.

This drive can be realised in many different ways, for example by means of a chain drive, driven by a motor or crank mechanism, in the hollow rail 4 or suchlike.

Furthermore the folding mechanism 1 is provided with a sequential mechanism 15 that connects the driven runner 5 with the other runners 5 in order to slide all of these runners 5 in a synchronised manner towards or away from each other.

Figure 10:
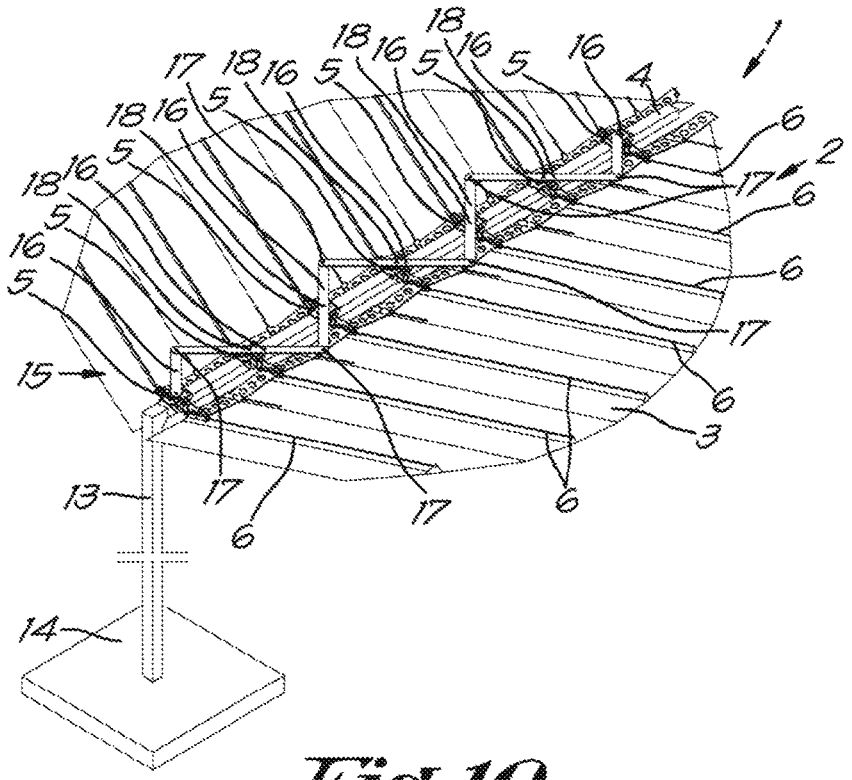
FIG. 10 shows a folding mechanism such as the one in FIG. 1 but made double-sided as a horizontal sunshade supported by a supporting pole on a base and provided with a drive.

In the arrangement in FIG. 10 the sequential mechanism 15 is formed with rods 16 which are connected hingeably with each other at their ends 17 and which are each attached hingeably to a runner 5 by a central point 18.

When the furthest driven runner 5 is moved towards the supporting pole 13 from the position in FIG. 10, the rods 16 between this runner 5 and the subsequent second runner 5 will be forced to rotate on the runners.

Due to the rotation of the rod 16 on the second runner, the rod 16 is also turned on the third runner whereby the second and the third runner 5 are moved towards each other.

In this way all runners are pulled towards each other and towards the supporting pole 13 if the runner 5 which is closest to the supporting pole 13 is a fixed runner.

Figure 11:
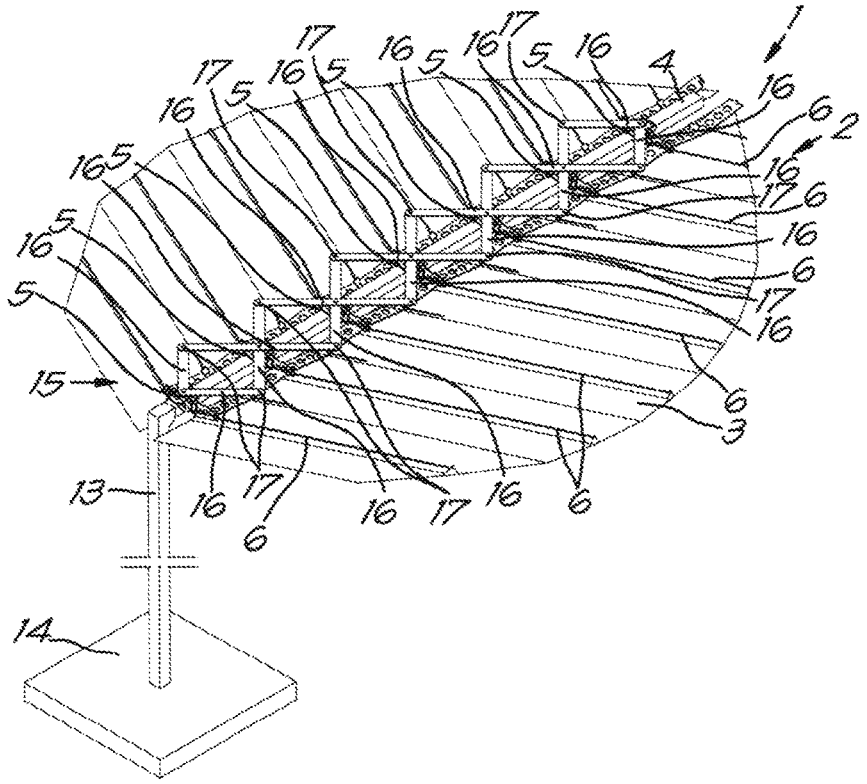
FIG. 11 shows a variant of the folding mechanism in FIG. 10.

The alternative embodiment of FIG. 11 differs from the one in FIG. 11 by the fact that in FIG. 11 a sequential mechanism 15 is applied with a double-rod system, each runner 5 having two rods 16 lying cross-ways across each other, like the handles of a pair of scissors, each rod attached hingeably at a central point 18 to the appropriate runner 5.

The rail 4 and the supporting pole 13 can be made hollow, for example to allow cables for lighting or heating to be attached under the rail 4 or for the integration of the drive and/or a sequential mechanism or part thereof.

A folding mechanism 1 according to the invention can for example also be used to fold open and shut a foldable bed, whereby the rail 4 is then attached horizontally on a supporting frame and whereby the cloth 3 is supported by the ribs 6 and the intermediate ribs, if any. In this case it is best for the runners 5 to be attached under the rail 4 rather than above it as in the figures discussed.

The shape of the cloth 3 and the length of the ribs 6 can of course be adapted to obtain a rectangular bed, although other shapes are also imaginable.

It is clear that the rail 4 does not necessarily need to be set up horizontally but can also be placed in any direction, for example vertically in an application like a wind sail or as a sail on a sailing boat or suchlike.

Figure 12:
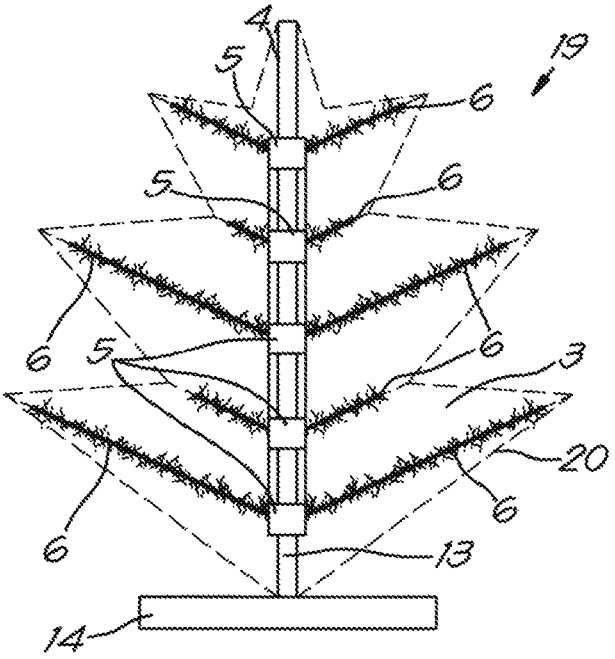
FIG. 12 illustrates an application of a folding mechanism in the embodiment of a foldable artificial Christmas tree.

In FIG. 12 an example is shown of a vertical arrangement for folding open an artificial foldable Christmas tree 19, whose branches are formed by the ribs 6 and intermediate ribs 12 upon which plastic needles 20 are attached.

Alternatively the folding mechanism 1 can be used to stretch open a cloth 3 with a silhouette of a Christmas tree as shown with a dotted line in FIG. 12.

In order to obtain a three-dimensional form it is for example possible for the runners 5 to be provided with ribs which unfold in various planes, for example in two orthogonal planes with four ribs 6 per runner 5, whereby the runners 5 are then for example made as sleeves that fit snugly around the rail 4.

The present invention is by no means limited to the embodiments described as an example and shown in the drawings, but a folding mechanism according to the invention can be realised in ail kinds of forms, dimensions and applications without departing from the scope of the invention.

The invention claimed is:

1. A folding mechanism, comprising:

a rail which forms a guide for a series of runners which are slideable in relation to each other on the rail, each of the runners or at least a part of each of the runners is provided with a rib which is hingeably attached on the respective runner around a shaft substantially perpendicular to the longitudinal direction of the rail between an open position in which the ribs are turned away from the rail and a closed position in which the ribs are turned towards the rail and at least some of the ribs located on the same side of the rail are connected with each other by a respective transmission which, when sliding the runners towards or away from each other on the rail, makes the ribs hinge on the runners, the transmissions keeping the ribs parallel to each other while opening and closing the folding mechanism, each of the transmissions being formed by an articulated connection connecting two of the ribs with each other via a hinge connection with each of the two ribs around the longitudinal axis of the two ribs, the articulated connection between the two ribs being provided with a central articulation with a shaft that runs parallel with the two ribs, the articulated connection containing two articulated parts with the central articulation, the shaft of the central articulation running parallel with shafts of the hinge connections with the ribs, the two articulated parts being two slats which are connected with each other at one end by said central articulation, the shaft of the central articulation being positioned at an angle in relation to the longitudinal direction of the slats, the two slats being provided with a respective hinge connection with the ribs on another end of the two slats, the hinge connections with the shafts running parallel with and at the same orthogonal distance from the shaft of the central articulation.

2. The folding mechanism according to claim 1, wherein one or more additional intermediate ribs are provided, each in the continuation of or on the shaft of the central articulation of the transmission.

3. The folding mechanism according to claim 1, wherein at least one of the ribs is of a different length compared to the other ribs.

4. The folding mechanism according to claim 1, further comprising a drive configured to slide at least one of the runners.

5. The folding mechanism according to claim 1, further comprising a drive configured to slide at least one of the runners, the at least one runner being connected with other ones of the runners via a sequential mechanism configured to slide the other runners in a synchronized manner towards or away from each other on the rail.

6. The folding mechanism according to claim 5, wherein the drive contains a motor.

7. The folding mechanism according to claim 5, wherein the drive contains a pulley system over which a cord is guided which is connected with the at least one driven runner.

8. The folding mechanism according to claim 1, further comprising a cloth that is fixed to one or more of the ribs such that, by opening and closing the folding mechanism, the cloth is folded open or shut.

9. The folding mechanism according to claim 8, wherein the folding mechanism is for a sunshade or a wind shield.

10. The folding mechanism according to claim 8, wherein the folding mechanism is for a sail on a sailing boat.

11. The folding mechanism according to claim 8, wherein the folding mechanism is for a foldable bed.

12. The folding mechanism according to claim 1, wherein the folding mechanism is for an artificial tree having branches formed by the ribs of the folding mechanism.

13. The folding mechanism according to claim 1, wherein, when the folding mechanism is open, the articulated parts of each of the transmissions lie in or almost in the continuation of each other and run parallel or substantially parallel with the rail.

14. A folding mechanism, comprising:

a rail which forms a guide for a series of runners which are slideable in relation to each other on the rail, each of the runners or at least a part of each of the runners is provided with a rib which is hingeably attached on the respective runner around a shaft substantially perpendicular to the longitudinal direction of the rail between an open position in which the ribs are turned away from the rail and a closed position in which the ribs are turned towards the rail and at least some of the ribs located on the same side of the rail are connected with each other by a respective transmission which, when sliding the runners towards or away from each other on the rail, makes the ribs hinge on the runners, the transmissions keeping the ribs parallel to each other while opening and closing the folding mechanism, each of the transmissions being formed by an articulated connection connecting two of the ribs with each other via a hinge connection with each of the two ribs around the longitudinal axis of the two ribs, the articulated connection between the two ribs being provided with a central articulation with a shaft that runs parallel with the two ribs, the articulated connection containing two articulated parts with the central articulation, the shaft of the central articulation running parallel with shafts of the hinge connections with the ribs, wherein, when the folding mechanism is open, the articulated parts of each of the transmissions lie in or almost in the continuation of each other and run parallel or substantially parallel with the rail.

15. A folding mechanism, comprising:

a rail which forms a guide for a series of runners which are slideable in relation to each other on the rail, each of the runners or at least a part of each of the runners is provided with a rib which is hingeably attached on the respective runner around a shaft substantially perpendicular to the longitudinal direction of the rail between an open position in which the ribs are turned away from the rail and a closed position in which the ribs are turned towards the rail and at least some of the ribs located on the same side of the rail are connected with each other by a respective transmission which, when sliding the runners towards or away from each other on the rail, makes the ribs hinge on the runners, wherein the orthogonal distance between each pair of consecutive ribs is the same.

16. A folding mechanism, comprising:

a rail which forms a guide for a series of runners which are slideable in relation to each other on the rail, each of the runners or at least a part of each of the runners is provided with a rib which is hingeably attached on the respective runner around a shaft substantially perpendicular to the longitudinal direction of the rail between an open position in which the ribs are turned away from the rail and a closed position in which the ribs are turned towards the rail and at least some of the ribs located on the same side of the rail are connected with each other by a respective transmission which, when sliding the runners towards or away from each other on the rail, makes the ribs hinge on the runners, wherein the runners on both sides of the rail are provided with the ribs which are attached hingeably thereon and are connected in pairs by said respective transmission.

* * * * *